United States Patent [19]

Jeffrey

[11] Patent Number: 4,748,792

[45] Date of Patent: Jun. 7, 1988

[54] FORMING AND PACKAGING ARTICLES OF COMPRESSIBLE FOAM MATERIAL

[75] Inventor: Peter Jeffrey, Liverpool, England

[73] Assignee: 501 Rollsponge International Limited, Stockport, England

[21] Appl. No.: 888,326

[22] PCT Filed: Oct. 28, 1985

[86] PCT No.: PCT/GB85/00501

§ 371 Date: Jun. 27, 1986

§ 102(e) Date: Jun. 27, 1986

[87] PCT Pub. No.: WO86/02616

PCT Pub. Date: May 9, 1986

[30] Foreign Application Priority Data

Jul. 17, 1985 [GB] United Kingdom ..... 8518048
Jul. 17, 1985 [GB] United Kingdom ..... 8518050

[51] Int. Cl.[4] ..... B65B 63/04
[52] U.S. Cl. ..... 53/116; 53/528
[58] Field of Search ..... 53/116, 117, 118, 214, 53/207, 208, 216, 526, 528, 587

[56] References Cited

U.S. PATENT DOCUMENTS

| | | | |
|---|---|---|---|
| 2,613,487 | 10/1952 | Vaughn | 53/431 |
| 3,097,464 | 7/1963 | Reeves | 53/116 X |
| 3,423,901 | 1/1969 | Peppler | 53/587 X |
| 3,429,097 | 2/1969 | Jasper et al. | 53/216 X |
| 3,546,846 | 12/1970 | Sens | 53/433 |
| 3,927,504 | 12/1975 | Forrister | 53/216 X |
| 4,528,794 | 7/1985 | Thierstein | 53/118 |
| 4,602,471 | 7/1986 | Gray et al. | 53/118 X |

FOREIGN PATENT DOCUMENTS

| | | | |
|---|---|---|---|
| 594546 | 3/1930 | Fed. Rep. of Germany . | |
| 1061250 | 7/1959 | Fed. Rep. of Germany | 53/216 |
| 2610404 | 9/1977 | Fed. Rep. of Germany | 53/216 |
| 1372595 | 8/1964 | France . | |
| 711544 | 7/1954 | United Kingdom . | |

*Primary Examiner*—Robert L. Spruill
*Assistant Examiner*—Steven P. Weihrouch
*Attorney, Agent, or Firm*—Mattern, Ware, Stoltz & Fressola

[57] ABSTRACT

An apparatus for forming and packaging articles of resilient compressible foam material is disclosed. The individual sheets of foam material are formed and introduced between confronting surfaces of the apparatus. Relative motion between the surfaces causes the sheets to roll upon themselves to form a compressed rolled article. Labels or wrappers are introduced at the trailing end of the sheets whereby the rolled article is compressed and rolled within the labels or wrappers.

8 Claims, 3 Drawing Sheets

FORMING AND PACKAGING ARTICLES OF COMPRESSIBLE FOAM MATERIAL

This invention relates to forming and packaging articles of compressible, actually resilient, foam or sponge material (hereinafter called "foam").

There are obvious advantages in packaging such articles in a compressed or partially compressed state as the resulting package will be smaller, thus more readily handled individually and transported in bulk, but, as such materials are usually of low density, without any problem arising from batch-load weights.

In putting this invention into practice, we are particularly concerned with pad-like articles, i.e. three-dimensional with one dimension (herein called "thickness") smaller than at least one usually both of the other two; and, for such an article, with presenting it rolled up, i.e. thickness-upon-thickness, within a wrapper, and preferably with a degree of volumetric compression in, usually throughout, its thickness.

The result is a package that is particularly easy to handle and is well suited to articles whose foam is of open-cell type, and which is preloaded with a useful substance, usually of liquid or otherwise injectable and retainable form, for some specific or general purpose, for example cleansing, sterilising, polishing etc. The extent of such preloading and the extent of volumetric compression can, of course, be correlated so as to give a satisfactory package relative to its size and load-retention.

Suitable apparatus comprises a roll-forming mechanism having confronted surfaces between which foam sheet or ribbon is fed, one of the surfaces being movable relative to the other in the desired feed direction so as to roll up and compress a prepared length of the foam sheet or ribbon accompanied by a label sheet whose opposite edges meet in making a tube about the rolled-up foam while translating the article between the surfaces from in-feed to exit positions. Such other surface may be stationary and will preferably present at least as much, usually similar, grip to the foam as does the one surface. Then the foam sheet or ribbon will be slowed if not stopped at one of its surfaces by said other surface of the roll-forming mechanism whose said one surface will continue to transport the other surface of the foam sheet or ribbon thereby forcing the prepared length thereof to roll up into a roll of a diameter equal to the exit spacing of the confronting surfaces, i.e. the original thickness of the foam at entry into the roll-forming mechanism if such confronting surfaces are basically parallel.

It is further envisaged herein that additional provision is made for compressing the foam prior to entry into the aforesaid roll-forming mechanism, thereby permitting yet further compression of its thickness in a yet more compact resulting article. This can be achieved where said one (relatively moving) of the confronting surfaces of the roll-forming mechanism extends beyond said other of those surfaces at the foam in-feed end and that other surface has an inclined extension that is substantially non-gripping for said foam which is thus compressed to reduce its thickness as it is drawn along by said one of the confronting surfaces. A practical alternative to such inclined extension is a roller or set of rollers appropriately sized and positioned to achieve the desired precompression of the foam material prior to entering the confronting surfaces. Another, and usually preferable, precompression provision comprises a driven belt suitably bearing on the foam and further preferably driven at substantially the same speed as the relatively moving surface of the roll-forming mechanism.

Any tendency for the preloading substance of the foam to become expressed and build up on the front edge and/or at least partially clog foam-gripping provision of the aforesaid other surface of the roll-forming mechanism can be avoided or at least reduced by particular temporary and localised extra compression of the foam at entry of the roll-forming mechanism and applied to the foam surface that will engage said other surface of the roll-forming mechanism, say by so-called doctor blade at the end of said other surface. Such doctor blade can thus be either at the junction of such other surface with the above-mentioned inclined (in-feed end) extension thereof, or after said roller or set of rollers or said driven belt, but is conveniently at the first encountered edge of the relatively stationary surface of the roll-forming mechanism.

Prepared lengths of the foam sheet or ribbon can be presented to the in-feed end of the roll-forming mechanism via means controlled by a reciprocable ram device or devices, say operating relative to a stack of pads constituting said prepared lengths, or even hand-fed such pads. Alternatively and advantageously, a reel of continuous foam sheet or ribbon, i.e. a convenient stock form for sheet or ribbon material to be unreeled therefrom, is associated with an indexed feed to the roll-forming mechanism and a severing station. A suitable indexed feed comprises an intermittently driven tractor mechanism that has confronting driven surfaces engaging the foam sheet or ribbon at both its sides, preferably of confronting belt type that can conveniently be driven equally from an accurately controlled electric stepper motor.

A suitable severing station employs a rotating cutter blade movable into and out of foam engagement, and is preferably of a type affording a low moving mass, say on a drive arm from a fixed drive motor and pivotted relative thereto. Such severing station will normally be at or after output from the above-mentioned tractor feed mechanism.

A suitable transport system from the severing station to the roll-forming mechanism comprises means for engaging the foam from sides only, preferably with a light compression of the foam in its width. Such engaging means may be effective within the thickness of the foam and can comprise moving filamentary members, for example cords, whose movement is preferably also on an intermittent basis matching indexing of the above-mentioned tractor mechanism.

It is to be understood that the term "prepared length" as used thus far does not necessarily imply preloading with a desired substance though any such loading will, of course, have to be present prior to action of the roll-forming mechanism. Preferably such preloading is performed on an intermittent cyclical basis, i.e. once per ultimate prepared length, as it is important to have assurance that each such prepared length contains a required amount of preloading substance.

Injection of the preloading substance directly into the foam material via jets themselves engaging, preferably entrant, the material is found to be suitable. Clearly, the quantity and evenness of distribution of the injected substance for each prepared length of foam material is important to quality control for the final products. Accordingly, rather than rely on timed injection (when pressure and effective jet size are the controlling other parameters), we prefer to use a positively and quantitatively metered injection, say using a piston-and-cylinder device to drive a prescribed of volume of cylinder contents to a head and thence out of jets thereof into foam, such piston-and-cylinder device operating once per prepared length, i.e. preferably (but not necessarily) after or at severance thereof. Moreover, we further prefer to use a substantial number of jets, i.e. greater than four, that in one implementation hereof can satisfactorily be twelve for prepared lengths measuring about 90 mm×200 mm. Such jets can be evenly distributed over a head of a size substantially matching a said prepared length of foam sheet or ribbon, and preferably project therefrom to penetrate into the thickness of the foam at actual injection.

Such injection station can be located before or after the aforesaid severing station, the two stations most conveniently being operated in conjunction so that severing begins with or just after injection and ends at or just before injection is complete, though just after will usually be acceptable in view of time lag in the injected substance spreading through the foam. In one implementation, the foam is indexed between injection and severing considering the same prepared length. At least the, the injection and severing provisions may be within the extent of a lower one of moving belts of the tractor mechanism.

Before considering label feed system, we revert to the aforesaid supply of foam sheet from continuous reel stock. Such reel stock, whilst self-evidently best provided at nominal uncompressed thickness for the foam sheet, so as to avoid slicing, is preferably very much wider than required for the finished products and so is conveniently subjected to slitting down to a required width. Such slitting can be performed at take-off from the reel either so that only the required width is taken off but same is done successively relative to the total width of the reel with end-to-end joining of successive such required width take-offs to give substantially continuous operation relative at least to one full reel, or at a multiple bladed slitting station where required widths are formed simultaneously across the width of the reel and fed in parallel through the severing, injection and roll-up stations. One suitable reel of 35 mm thick foam sheet is 2 meters wide and holds 60 meters length, i.e. giving a total availability of at least 6500 units for about 90 mm×200 mm sizes of prepared lengths.

Turning to labels and label feed, these can also come in continuous connected form, to be fed into a nip between the foam sheet and said one (relatively moving) surface of the roll-forming mechanism, usually and preferably after being severed and at a position on the or each prepared length that assures overlapping of ends of the label about the or each rolled-up foam length, i.e. extending over a remaining length of the foam sheet or ribbon that is less than the length of the label. We particularly prefer that the labels be drawn from continuous stock, which may be fan-folded thereby avoiding high inertia etc. of rotating reels, or of reel form but associated with an unreeling feed that removes tension and inertia effects after the feed station.

Fixing of each label in position relative to its foam-roll during formation of the latter is conveniently by using an adhesive, preferably offering a reasonable bond to the foam but not so strong as to be difficult for the user to strip off. In practice, use of ready-gummed labels on carrier sheet turns out to be less than consistently satisfactory from the point of view, at least unless the labels have only localised adhesive near to each end.

Provision of a label stripping station and for take-up of waste carrier sheet can advantageously be avoided by providing for adhesive application and label severance during passage from the preferred fan-fold stack to the roll-forming station. Such adhesive application is readily achieved by an intermittently operable applicator device, whether as strips or as series of spaced adhesive dots which is a system yet more readily arranged to provide for a lesser bond to the foam, say by fewer adhesive dots, than between overlapped ends of the label, say by more adhesive dots, preferably enough to form a substantially continuous strip at superposing of the other end of the label.

It is further preferred to provide means for assisting label removal from the resulting label-enclosed rolled-up foam product, which can be achieved via a tear thread applied to the adhesive at or near the label and to first engage the foam or sponge material during roll-forming, or yet more simply by imposing tear-assist formations to the labels close to their ends but inboard of the adhesive thereat. Suitable tear-assist formations could be lines of perforations, or, more simply, quite short edge-nicks.

In one label supply system, a movable label placing plate has labels fed thereto, adhesive applied to label for attachment at or after the leading edge of a severed foam length movement of the placing plate against the foam between the severing station and the roll-forming mechanism, and adhesive applied to label after the trailing edge of that severed foam length, whereafter the next label is fed onto the placing plate.

Another possible label feed-transport system comprises a tractor roll(s) or roller(s) serving as a label sheet feed, a suction table below a driven perforate belt or net, mesh gauze or like material, to receive the output from the tractor roll or rolls and afford support at least for operation of adhesive application means, and a guide to take the labels from the suction table/belt means to the nip of the roll-forming mechanism between its one said surface and the foam/sponge material being rolled, and affording support during severance of the labels if not already severed on the suction table/belt means.

It will be appreciated that each of the aforesaid features, of appropriate sub-combinations thereof constitute in themselves, significant contributions to efficient operation of label-enclosed rolled-up foam articles. It will further be appreciated that employment of various aspects of apparatus hereof each or in combinations constitute or constitutes implementation of process' aspects of this invention and that resulting label-enclosed rolled-up products have, in themselves, one or more novel and inventive features.

Thus, regarding process aspects, there are at least the following aspects:

(a) Formation by severance from reel of foam sheet stock.
(b) Injection of preloaded substance more evenly over the are of a product length of foam sheet.
(c) Precomposition of foam sheet prior to roll-forming.
(d) Edge-engaged transport of severed lengths of foam material.
(e) Label formation from continuous sheet stock.
(f) Application of adhesive to end-adjacent portions of the labels.
(g) Provision of tear-assists.

And, regarding product aspects, there are at least the following aspects:

(h) Features resulting from (b).

(i) Features resulting from (c).

(j) Features resulting from (g).

Specific implementation of such features together with now be described, by way of example, with reference to the accompanying drawings, in which.

In the Figures, it is to be understood that what is shown is primarily for illustrative purposes in aid of the description that follows, and nothing is intended to be to scale.

Figure 1:
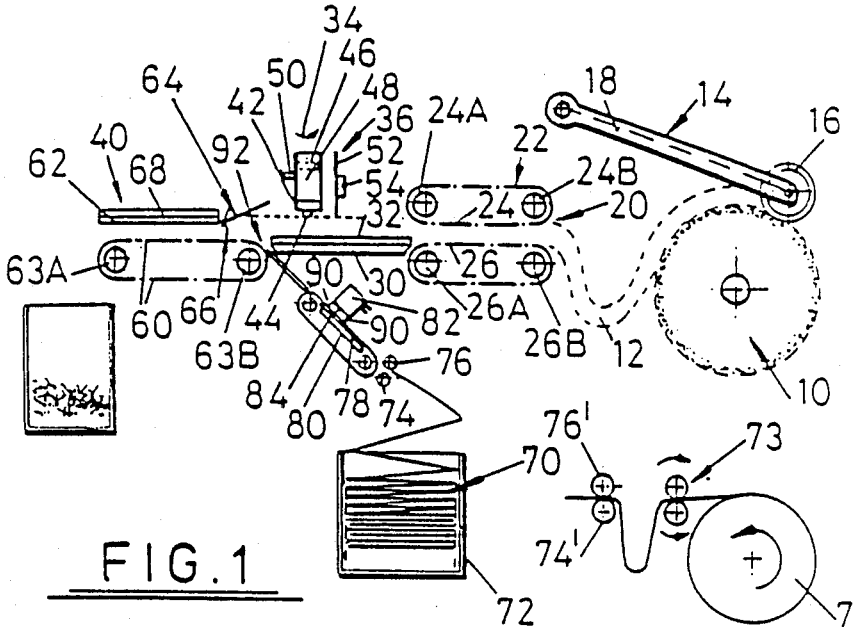
FIG. 1 is a diagrammatic overall indication of apparatus for producing label-enclosed roll-formed foam/-sponge articles.

FIG. 1 shows a reel 10 of stock foam or sponge material in sheet form 12 and an associated slitter mechanism 14, for example having a circular driven blade 16 on a pivotal arm 18 to provide only a prescribed width of the stock foam or sponge material. The reel carrier (not shown) is conveniently indexed out of the plane of the drawing between successive feeds of slit material therefrom, which may be connected together end-to-end. Moreover, a continuous unreeling drive may be applied during each slit delivery with a loop normally formed before entry at 20 into an indexed tractor transport mechanism 22.

Figure 2:
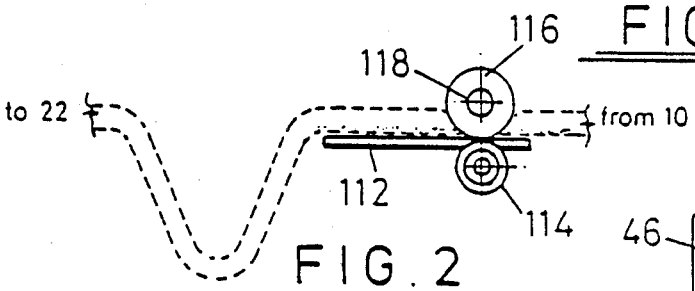
FIG. 2 shows alternative foam sheet take-off and slitting.

FIG. 2 shows an alternative where a plurality of slitter blades 116 equally spaced on a roll 118 (by the desired width of prepared lengths of foam) are associated with a cushion roll 114 to draw the full widths of stock foam from its reel and slit same on the slitting table 112 which is slotted to take said blades 116. The tractor transport mechanism and other stations and apparatus to be described can then of course operate simultaneously for the slit foam, i.e. in parallel say for over twenty such at 90 mm from a 2 meter wide reel.

As shown, the tractor mechanism 22 comprises confronting moving surfaces 24 and 26 to engage the sheet 12 from both sides, actually above and below. That is readily achieved where the surface 24 and 26 are of endless belt systems, say using end guide or drive rollers 24A, 24B and 26A, 26B, though drive could, if desired or if preferred, be applied medially. In any event, drive is to be intermittent and acceptably reliable in relation to desired prescribed lengths of the sheet material 12. A drive system utilising an electric stepper motor is found to be particularly effective, or a control system using optical sensing of holes in a disc rotating with one of the drums or rolls.

From the tractor mechanism 22, the sheet passes over a support table or tables 30, usually between upstanding side guides 32 through an injection type preloading station 34 and a severing station 36 on its way to a roll-forming mechanism 40.

Figure 5:
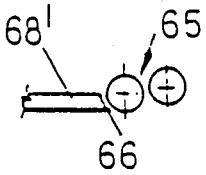
FIGS. 5 and 6 shows alternative foam sheet precompression.
Figure 11:
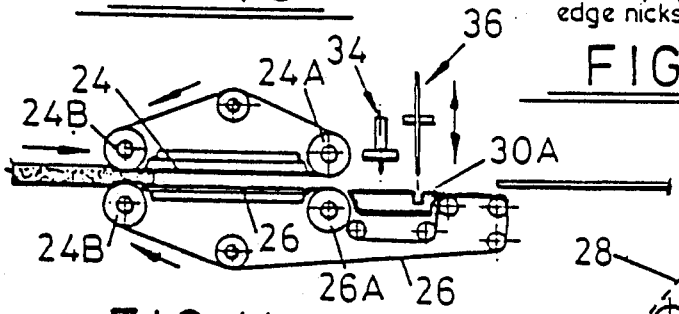
FIGS. 11 and 11A show more detail of foam feed prior to roll-up.
Figure 11A:
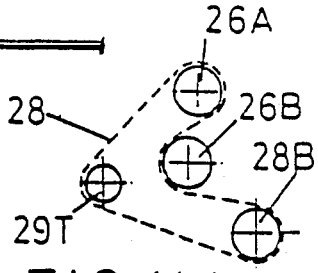

FIG. 11 shows a variant tractor mechanism with the parts thereof designated by numerals similar to the numerals for like parts found in the first embodiment but increased by 100. The FIG. 11 tractor mechanism includes an extension of its lower drive belt system at 126A to go under and beyond an injection/severing table 130A, e.g., with a chain drive 128 via a drive wheel 128B and tensioner 128T (as shown in FIG. 11A) to sprockets on rolls or drums 124B, 126B. See also FIG. 5 for a system with a drive wheel 29D on the same shaft as the roll 26B and sprockets at the other side for chain 29 with a tensioner 29T in a channel on a base frame member 120B of which two such (see also 120A) form sides of a rectangular base frame.

Figure 3:
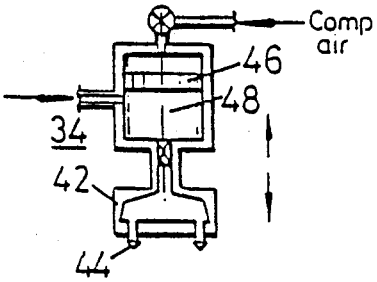
FIGS. 3 and 4 show more detail of injection of preloading substances.
Figure 4:
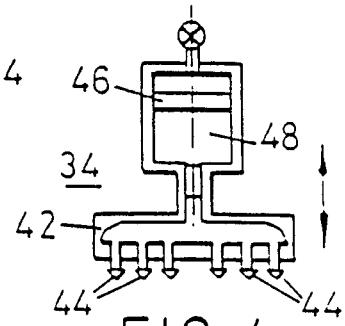

A preferred injection station 34, see also FIGS. 3 and 4, comprises a head part 42 having a plurality of exit apertures or jets 44 disposed over the foam sheet 12 so as evenly to inject a preloading substance at operation of a piston-and-cylinder device 46, 48 supplied with said substance at 50. For a 90 mm width of foam sheet 12, we find that more than four such apertures or jets 44 are required, and have actually used ten or twelve spaced in the direction of foam sheet feed and in two or more rows spaced transversely to the direction of feed of the foam sheet. Projecting jets 44 should be capable of entering the thickness of the foam before injection begins.

Figure 7:
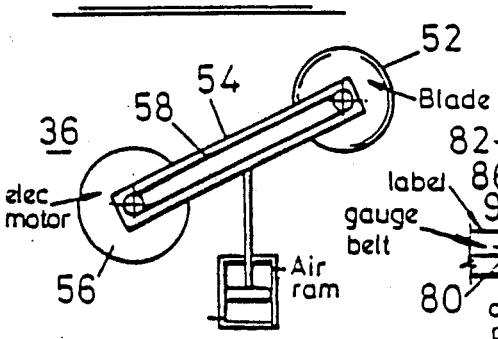
FIG. 7 shows foam sheet severing to product length.
Figure 14A:
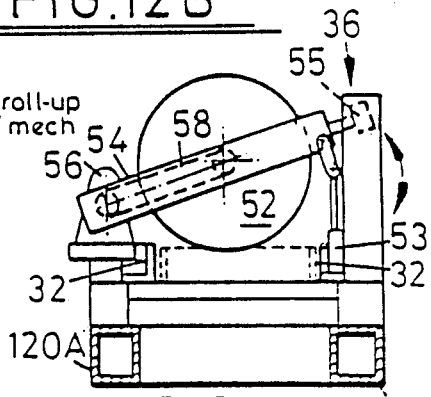
FIGS. 14A and 14B show more detail of foam sheet severing.
Figure 14B:
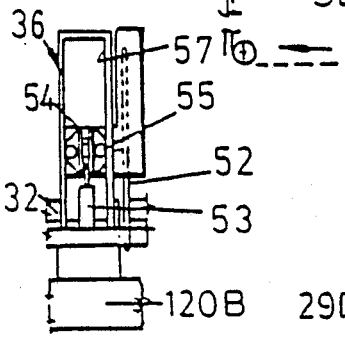
Figure 15:
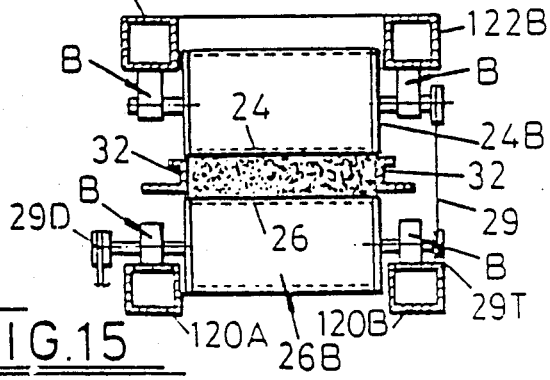
FIG. 15 is a transverse view of a tractor mechanism.

A preferred severing station 36, see also FIG. 7, and FIGS. 14A and 14B comprises a rotating blade 52 on a pivotal arm 54 from a drive motor 56, with a drive transmission 58 along such arm 54 to the blade 52 and an extensible and retractable ram 53 to pivot the arm 54. A roller and slot guidance system is also shown at 55, 57 in FIGS. 14A and 14B.

The roll-forming mechanism 40 has confronting surfaces 60, 62, one of which (60) is movable relative to the other (62) in the same direction as feed for the foam sheet 12. As shown, surface 60 is movable and surface 62 is stationary. Surface 60 will grip the sheet for traction purposes and is of an endless belt guided or driven at end rollers 63A, 63B, or medially, and conveniently continuously. Surface 62 is shown as a pad of rubber or other material suitable to assure a sufficiently gripping nature to stop that surface (actually upper as shown) of the foam sheet that comes into contact therewith and may be of the same or similar material to the other surface 60 that forces roll-up of the foam sheet.

Figure 6:
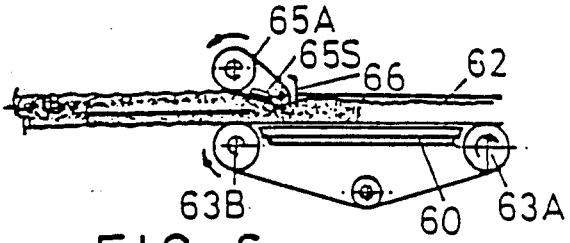

Inevitably, the action of the roll-forming mechanism 40 involves substantial compression of the lengths of foam sheet 12 entrant thereto. As aforementioned, we find that achievement of same evenly and/or achievement of maximum viable compression (and thus smallest practicable diameter of the resulting product) is or are significantly aided by applying a degree of precompression to the foam sheet 12 as it enters the roll-forming mechanism 40. That can be achieved via a sloping guide plate 64 to the surface 62 above extension of the surface 60 beyond the surface 62 proper at the in-feed end of the mechanism 40, or by a set of rollers 65, see FIG. 5, or by a driven belt system 65A, see FIG. 6 (the belt usefully being synchronized to the speed of the moving surface 60").

A more steeply inclined projecting doctor blade (66, 66', 66") is also shown after the guide plate 64 or rollers 65 or belt 65A at the end of surface (62, 62', 62") actually the substrate (68, 68', 68") for a pad affording the surface (62, 62', 62"). Such projection of blade (66, 66', 66") will supply localised further compression to the foam sheet 12 prior to its engagement of the surface (62, 62', 62"), and will serve to prevent or reduce build up of expressed preloading substances on the edge of the pad for surface (62, 62', 62") and/or clogging of the latter. Provision for such localised further compression via a blade is preferred as the latter is particularly readily made adjustable. However, a rib formation on the end of the guide plate 64 could be used if desired.

The injection and severing stations 34 and 36 operate between indexing feed movements of the tractor mechanism 22, i.e. relative to foam sheet 12 that is stationary on the support table or tables 30 (or 30A), which may present a substantially non-grip surface to the foam sheet thereon, so that the latter moves easily when pushed by action of the tractor mechanism 22. Preferably however, we provide a further traction system between the stations 34, 36 and the roll-forming mechanism 40, which system uses edge-engaging filamentary members 100A, 100B, see FIGS. 12A–12B showing endless cords. Advantageously, those cords hold the severed lengths of foam in slight transverse tension, and are operated intermittently in step with and at substantially the same speed as the moving surface of the tractor mechanism 22. Foam side-engaging and return runs of the cores 100A and 100B are set by idler rollers 102, and drive is applied from drive wheels 104 at rolls 106A, 106B in loops over further idler rollers 108. Transverse compression of the foam lengths between the cords, say with the latter impressed up to 3 mm into the sides of those lengths holds the latter adequately for the purposes hereof without requiring further side guides.

Reverting to the roll-forming mechanism 40, it will be appreciated that the output diameter of rolled-up products will correspond to the exit spacing of the surfaces 60 and 62, i.e. leftmost end of the mechanism in FIG. 1. As shown, such diameter will correspond to that dimension to which the foam sheet 12 is pre-compressed by the guide plate 64, i.e involving a multiple of further such compressions corresponding to the number of super-positions of sheet thicknesses in the resulting rolled-up product. Requirements for product control as to evenness of compressed throughout its rolled-up length may be better served if the surfaces 60 and 62 diverge in the direction of roll-forming, say by sloping the surface 62 relative to the surface 60 so that the exit end has a wider spacing than junction of the surface 62 with the in-feed guide plate 64.

In any event, it will be appreciated that a cut label for the resulting product should be fed to the input end of the roll-forming mechanism 40 at some time before all of the product length of foam sheet 12 is drawn in, but, of course, not before what is left to be drawn in is of lesser length than the cut label.

Label stock, preferably with index markings for label lengths, is shown at 70 in a fan-fold form in a bin 72 from which it is withdrawn by an overhead pair of such rollers 74, 76 of which at least one is driven to withdraw the continuous fan-fold sheet with unfolding thereof in generally conventional manner, i.e. including such other means as are conventional to fan-fold dispensing for example as used in relation to computer printers.

Figure 1A:
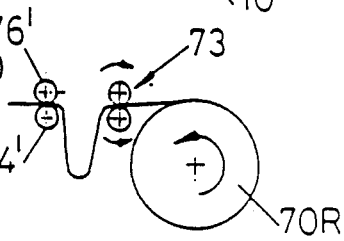
FIG. 1A shows variant label feed.

An alternative label feed, see FIG. 1A, can be from a reel 70R via continuously driven rollers 73 forming a loop before rollers 74', 76'. The reel 70R itself could also be driven, say further with a loop before the rollers 73.

From the rollers 74, 76 the label stock goes onto a belt feed conveyor 78 of perforate type passing over a so-called vacuum table 80 which applies suction to retain the label stock sheet on the belt feed conveyor 78.

Figure 8:
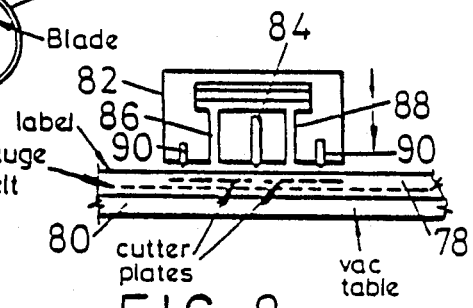
FIGS. 8 and 9 show more detail of combined severing/adhesive applicator/tear assist means for labels.
Figure 9:
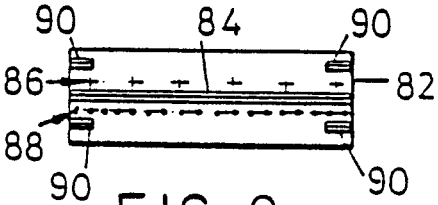
Figure 10:
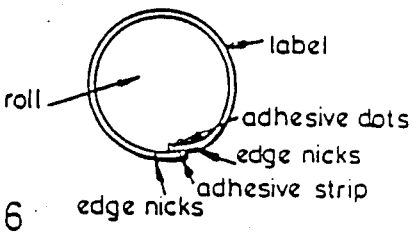
FIG. 10 shows more detail of a preferred labelenclosed rolled-up foam product.

It is clearly necessary on, or at least at exit from, the conveyor 78, for the label stock sheet to be severed to length, and we prefer herein also to apply adhesive close to both ends of such cut label lengths. Whilst that latter could be done by wiping brushes or adhesive feed jets reciprocable across the width of the label stock sheet, the preferred means hereof is combined with severance. Thus, see FIGS. 8 and 9, a head 82 has a transversely extending blade 84 between rows of adhesive dispensing jets 86 and 88 for label portions adjacent leading and trailing edges of successive labels, respectively.

Those jets 88 for the trailing label edge portions are shown greater in number and more closely spaced then those 86 for the leading label edge portions. Preferably, adhesive dots from the former, but not the latter, will spread at superposition of label edge portions to join together in a continuous strip. The result will be a stronger bond between overlapped label edge portions than between leading label edge portions and the foam sheet 12.

We find that such can assist provision for label removal. Thus, the relatively strong and continuous adhesive between overlapped label edge portions forms a relatively stiff strip relatively weakly adhered to the foam sheet of the product, and thus fairly readily gripped and torn off from one end by the user. Further assistance is rendered by providing edge-nicks in the label inboard of the adhesive application, and same is readily done at the severing/adhesive application head 82 by further short blades 90.

An alternative tear-assist provision could, of course, be a thread set onto the adhesive at the leading edges of the labels.

From the conveyor 78/suction table 80, the cut labels go over a guide plate into a nip at 92 between the surface 60 of the roll-forming mechanism 40 and the foam sheet 12 off the support table 30. The precompression action of the guide plate 64 actually aids such picking up of the labels at that nip.

A collection bin is shown at 94 for label-enclosed rolled-up products from the mechanism 40, but any other product handling system could be employed.

In relation to the label stock 70, it is assumed that such will arrive pre-printed, but a printing station could be included in the apparatus of system hereof, i.e. operating from blank fan-fold or reel label sheet stock.

Reverting to precompression by roll means (FIG. 5), it is advantageous for the roll concerned, or at least that nearest the substrate 68, to be as small in diameter as possible, and to be driven rather than idle at least when non-impregnated sponge bodies are to be rolled and packed. In fact, a belt system is useful, see FIG. 6 for belt 65A (which can be toothed) and associated support plate 65S, which can further readily deal with somewhat rounded edged/sided sponge bodies by compressing them beyond any doming thereof.

Figure 12:
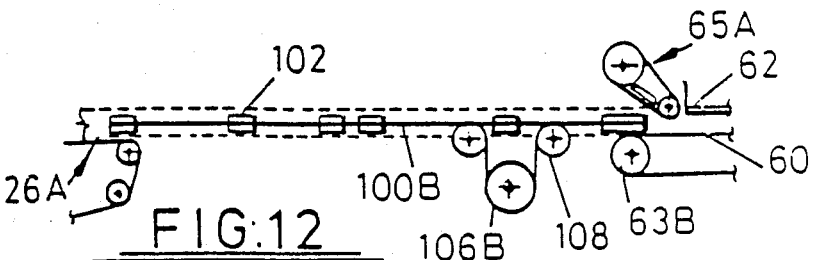
FIGS. 12, 12A and 12B show a side-engaging severed foam length feed.
Figure 12A:
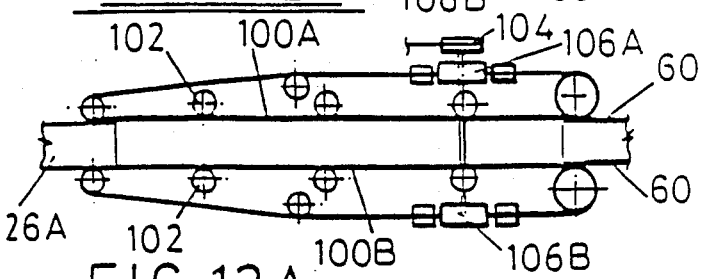
Figure 12B:
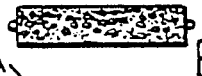
Figure 13:
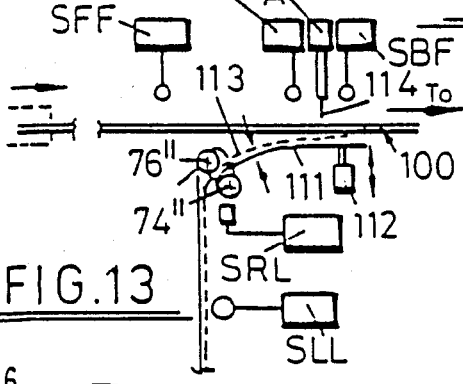
FIG. 13 shows another label severing/adhesive applicator system.

Another alternative label feed is shown in FIG. 13 where stock from a roll is taken via a guide system 110 to feed rollers 74'', 76'' and thence onto a plate 111 pivotal towards and away from the underside of the foam lengths in the cord transport system of FIG. 12, see ram 112, and light spring fingers 113 to hold the label stock on the plate 111. Adhesvie applicator jets 114 in a row are preferably timed to enter between foam lengths and apply hot melt adhesvie spots on the lables, all suitably timed via sensors for the front and back edges of a foam length (SFF, SBF), end of label (SEL), label length (SLL) and label address (SRL).

A suitable sequence of operations for indexed label drive involves driving label stock onto the plate, sensing the front edge of a foam length to control lowering and operating the adhesive spotting mechanism (A) to apply spots of glue to the forward label edge part, sensing the rear edge of the foam length and raising the label plate to the foam length so as to attach the label by its front edge part, sensing the end of the label and re-operating the adhesive spotting mechanism before advancing the next label onto the plate 111.

A suitable support frame system for the entire apparatus may comprise the aforesaid basic frame 120, plus at the tractor mechanism, relatively short a top frame portion 122, bearings/brackets (B) on both to hold roll/drive wheel axles, and side guides 32 for the foam up to the cord transport 100 where used.

I claim:

1. Apparatus for forming and packaging articles of resilient compressible foam material comprising first means for feeding pad-like foam articles having a thickness dimension smaller than its length and width dimensions, means for feeding a wrapper or label so that a leading edge portion of a wrapper or label is associated with a trailing edge portion of each pad-like article, and second means for feeding such pad-like articles successively, each with an associated wrapper or label between confronting surfaces of a roll forming mechanism, one said surface being movable relative to the other in the desired feed direction so as to roll up and compress the pad-like article within its wrapper or label thereby forming a tube about the rolled-up article while translating the article between the surfaces from an in-feed position for the articles and associated labels to an exit position for the wrapped article.

2. Apparatus according to claim 1, wherein each of the confronting surfaces first affords gripping engagement of a different one of opposite major faces of the foam article, and further comprising means for injecting a preloading substance into the foam prior to precompressing thereof, and means for pre-compressing the foam from its normal thickness at or prior to entry between the confronting surfaces.

3. Apparatus according to claim 2, wherein the first means for feeding pad-like foam articles includes a tractor mechanism having confronting surfaces driven intermittently on an indexing basis for continuous foam stock material, and severing means for cutting the foam stock material to lengths thereof corresponding to said indexing and to be rolled up with said wrapper or label.

4. Apparatus according to claim 3, wherein the severing means comprises raisable and lowerable rotary blade means operable between indexing of said tractor mechanism.

5. Apparatus according to claim 3, comprising transport means for severed lengths of foam material from the severing means to the roll-up mechanism, which transport means comprises side-edge engagers for the foam lengths and between which the foam lengths are lightly compressed in their widths.

6. Apparatus according to claim 1, comprising wrapper or label delivery means including means for emplacing rows of discrete spots of adhesive at or near each end of each wrapper or lable, the adhesive emplacing means being operative to put more spots at the trailing end of the wrapper or label closely enough together to afford tear-assistance on the finished product.

7. Apparatus according to claim 1 comprising wrapper or label emplacing means including indexed feed means for continuous roll stock, an emplacement plate movable towards and away from the foam lengths with a wrapper or label thereon, and cutting means for cutting labels from the continuous stock at the emplacement plate.

8. Apparatus according to claim 1 wherein said means for feeding the wrapper or label to each of the padlike articles with leading edge portions of the wrappers or labels attached onto the trailing edge portions of the corresponding pad-like articles includes means for introducing the labels or wrappers adjacent to the in-feed position of the confronting surfaces in synchronism with the trailing edge portions of the corresponding pad-like articles as the pad-like article is being rolled up by the relative motion of the confronting surface.

* * * * *